US005133271A

United States Patent [19]

Iwasaki et al.

[11] Patent Number: 5,133,271

[45] Date of Patent: Jul. 28, 1992

[54] POCKET SETTING DEVICE HAVING LABEL CLAMPING MECHANISM

[75] Inventors: Toshiaki Iwasaki; Satoshi Morii, both of Nagoya; Kunihiko Murata, Tsushima; Hiroyuki Mitsui, Kasugai, all of Japan

[73] Assignee: Brother Kogyo Kabushiki Kaisha, Nagoya, Japan

[21] Appl. No.: 788,434

[22] Filed: Nov. 6, 1991

[30] Foreign Application Priority Data

Dec. 13, 1990 [JP] Japan ..... 2-401977

[51] Int. Cl.[5] ..... D05B 3/20; D05B 35/06

[52] U.S. Cl. ..... 112/114; 112/147; 112/121.15; 223/38

[58] Field of Search ..... 112/104, 113, 114, 147, 112/121.15, 121.12, 262.3, 265.1; 223/38

[56] References Cited

U.S. PATENT DOCUMENTS 3,861,338 1/1975 Galya et al. ..... 112/104
4,982,676 1/1991 Morii et al. ..... 112/147 X
5,040,472 8/1991 Schips ..... 112/104
5,058,517 10/1991 Morii et al. ..... 112/147 X

FOREIGN PATENT DOCUMENTS 1-148294 6/1989 Japan ..... 112/113

*Primary Examiner*—Peter Nerbun
*Attorney, Agent, or Firm*—Oliff & Berridge

[57] ABSTRACT

A workpiece fabric folding device having a label clamping mechanism. The device is operated for folding back an outer end portion of a first workpiece fabric and for stitching the folded back portion to a second workpiece fabric by a sewing machine. In the folding back operation, a label piece is also positioned at the folded back portion for simultaneously stitching the label to the second workpiece fabric. The folding device includes a gauge plate whose outer contour defines a folding-back line of the first workpiece fabric, a bending depression member positioned above the gauge plate for bending the outer edge portion, and a plurality of folding segments for urging the bent outer edge to a position below the gauge plate. The label clamping mechanism is disposed on the bending depression member at a position adjacent the folded-back position. The mechanism includes a label clamping unit which holds one portion of the label, and moving unit for angularly moving the clamping unit to the folded-back position. The label clamping unit clamps the label when the unit has an upstanding posture, where the label can be horizontally insertable for the clamping. The label clamping unit is pivotally moved toward the folded-back position for positioning an unclamped part of the label at the folded-back position.

16 Claims, 9 Drawing Sheets

POCKET SETTING DEVICE HAVING LABEL CLAMPING MECHANISM

BACKGROUND OF THE INVENTION

The present invention relates to a sewing machine provided with a workpiece fabric folding device or a pocket setting device, and more particularly, to a type thereof in which a label is suitably stitched at a desired position on a sewing locus of a pocket cloth whose edge portions are folded relative to a garment.

A conventional pocket setter is adapted to stitch a pocket cloth (first workpiece fabric) to a front garment (second workpiece fabric). In this case, an outer edge portion of the pocket cloth is folded back, and the folded back portion is mounted on the garment, and is stitched along the folded edge portion to the garment. To this effect, the conventional pocket setter is provided with a gauge plate, a bending depression plate and folding segments. The gauge plate is provided for mounting thereon the pocket cloth at a position above a sewing table on which a garment is mounted. Further, the bending depression plate is provided for downwardly bending an outer edge portion of the pocket cloth along an external contour of the gauge plate. The bending depression plate is positioned over the pocket cloth mounted on the gauge plate and presses the pocket cloth for bending the outer edge portion thereof. Furthermore, the folding segments are provided movable in a direction parallel with the table for positioning the downwardly bent portion of the pocket cloth below the gauge plate. That is, the folding segments can be moved to positions below the gauge plate. Thus, the outer edge portion of the pocket cloth is folded back at a position above the garment, and the folded back portion is then stitched to the garment, to thereby provide a pocket to the garment.

Further, there has been proposed a sewing machine having a label feeding mechanism for automatically feeding a label to a stitched position. The sewing machine is provided with a grip unit for gripping a label, an arm having one end fixed to the grip unit and another end movably supported to a sewing machine frame, and an actuator for moving the arm. When the label is gripped by the grip unit, the arm is moved by the actuator. Accordingly, the label gripped by the grip unit is fed to a position below a pressure foot, and the label is then held on the sewing table by the pressure foot for stitching the label to a garment.

In the above conventional fabric folding device and the label feeding mechanism, it would be impossible to place the label at a proper stitched portion of the folded-back portion of the pocket cloth. That is, it would be impossible to simultaneously fold the label as well as the pocket cloth and to set the label together with the folded pocket cloth onto the garment for subsequent concurrent stitching of the label and the pocket cloth onto the garment.

SUMMARY OF THE INVENTION

In order to fulfill this demand, there has been a proposal through inhouse R & D activities with respect to a pocket setter having a label stitching unit in which the label can be stitched to a pocket cloth when the latter is stitched to a front garment. According to the pocket setter, a gauge plate is provided for mounting thereon the pocket cloth at a position above a sewing table on which a garment is spreadingly mounted. Further, a bending depression plate is provided for downwardly bending an outer edge portion of the pocket cloth along an external contour of the gauge plate. That is, the bending depression plate is positioned over the pocket cloth mounted on the gauge plate and presses the pocket cloth for bending the outer edge portion thereof. The bending depression plate mounts thereon a label clamping mechanism at an end portion thereof. Furthermore, a plurality of folding segments are provided movable in a direction parallel with the table for positioning the downwardly bend portion of the pocket cloth below the gauge plate. That is, the folding segments can be moved to positions below the gauge plate.

In operation, the pocket cloth is mounted on the gauge plate, and thereafter, the outer edge portion of the pocket cloth is bent downwardly by the bending depression plate. Next, one end portion of the label is clamped at a downwardly oriented tip end portion of the label clamping mechanism. Then, another end portion of the label and the outer edge portion of the pocket cloth are simultaneously folded to a position below the gauge plate by the folding segments. Further, while maintaining the folded state of the label and the outer edge portion of the pocket cloth, the bending depression plate, the gauge plate and the folding segments are moved downwardly onto the front garment. Then, one end portion of the label is released from the clamping mechanism, and the bending depression plate, the gauge plate and the folding segments are removed for simultaneously stitching the label and the pocket cloth to the front garment.

According to the above described inhouse proposal, the label clamping mechanism is fixedly secured to the end portion of the bending depression plate, and the tip end portion of the clamping mechanism which clamps the label is directed downwardly. Therefore, it would be rather difficult to attach the label to the label clamping mechanism. To be more specific, the label must be positioned below the tip end portion of the label clamping mechanism, and moved upwardly for insertion into the tip end portion. Accordingly, such label attaching work requires sophisticated observation and skill. Consequently, label setting work is hardly carried out to lower working efficiency.

Further, the gauge plate and the folding segments are positioned in the vicinity of the label clamping mechanism mounted at the end portion of the bending depression plate. With such spatial arrangement, it would be difficult to largely extend the tip end portion of the label clamping mechanism due to mechanical interference. Thus, large label attaching margin is required with respect to the clamping mechanism.

It is therefore, an object of the present invention to overcome the above described drawbacks and to provide an improved pocket setter having an improved label clamping mechanism capable of facilitating label attachment work with a minimized label attachment margin.

This and other objects of the invention will be attained by providing a workpiece fabric folding device for use in a sewing machine for folding an outer edge portion of a first workpiece fabric, the sewing machine having a sewing table on which a second workpiece fabric is mounted, the folded outer edge portion being stitched to the second workpiece fabric, the device including a gauge plate, a bending depression member, a plurality of folding segments, and a label clamping mechanism. The gauge plate is positioned above the sewing table for mounting thereon the first workpiece fabric, and the gauge plate has its outer edge. The bending depression member is movably positioned above the gauge plate for downwardly bending the outer edge portion of the first workpiece fabric along a contour of the outer edge of the gauge plate. The plurality of folding segments are movable to a position below the gauge plate for defining a folded-back position so as to position the downwardly bent portion of the first workpiece fabric at a position immediately below the gauge plate. The label clamping mechanism is positioned adjacent the folded-back position of the outer edge portion of the first workpiece fabric. The label clamping mechanism includes a label clamping means for clamping a part of a label, and moving means for moving the clamping means between a label receiving/clamping position and a label foldable position where the label is oriented in a direction parallel with the downwardly bent outer edge portion of the first workpiece fabric.

DETAILED DESCRIPTION OF THE PREFERRED EMBODIMENTS

A workpiece fabric folding device having a label clamping mechanism according to one embodiment of this invention will be described with reference to drawings. In the depicted embodiment, the folding device is adopted in a pocket setter which stitches a pocket cloth to a garment. Throughout the specification, the expressions "front", "rear", "above", "below" and "laterally" are used herein to define the various parts when the pocket setter is disposed in an orientation in which it is intended to be used.

Figure 1:
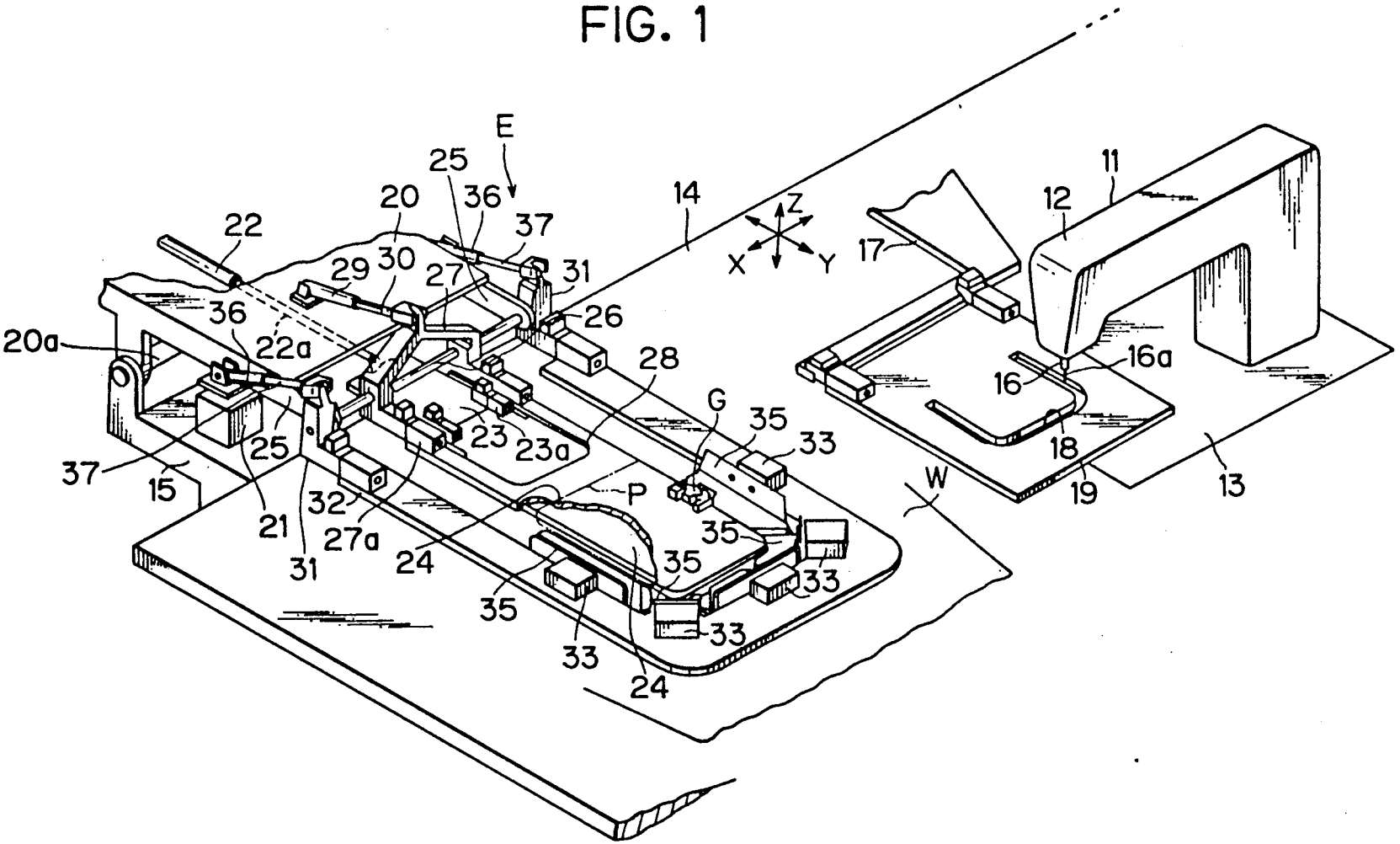
FIG. 1 is a perspective view showing a pocket setter having a label clamping mechanism according to one embodiment of the present invention.

An entire arrangement of the pocket setter is illustrated in FIG. 1. A sewing machine 11 having an arm portion 12 and a bed portion 13 is provided on a table 14. The arm portion 12 has a lower end portion at which a needle bar 16 having a sewing needle 16*a* is vertically reciprocally supported. In the bed portion 13, a thread looper (not shown) is provided for providing a stitch together with the sewing needle 16*a*. On the table 14, a feed arm 17 is provided movable in three directions (X, Y, Z-directions). Further, a feed plate 19 formed with a U-shaped needle guide slot 18 is detachably provided at a front portion of the feed arm 17. Various kinds of feed plates 19 are selectively attached to the feed arm 17, so that various shapes of needle guide slots are formed in accordance with an intended stitched locus and size of the pocket. During stitching operation, a pocket cloth (first workpiece fabric) P is placed on a front side garment (second workpiece fabric) W, and the second cloth W and the first cloth P to be stitched thereto are both moved along the needle guide slot 18 while these are depressed by the feed plate 19 onto the table 14.

To the table 14, a base 15 is fixed to which a support member 20 is pivotably supported by a pivot shaft 20*a*. A pneumatic cylinder 21 is mounted on the base 15 and is connected to the support member 20 for pivotally moving the same about the pivot shaft 20*a*. Further, another pneumatic cylinder 22 is fixed to a lower face of the support member 20. The other pneumatic cylinder 22 has a piston rod 22*a* whose tip end is connected to a gauge plate support member 23 on which the pocket cloth P is to be mounted. Further, a gauge plate 24 which determines an external contour of a pocket PK (FIG. 3) of a pocket cloth P has base leg portions which are provided detachably to the gauge plate support member 23 through fixing blocks 23*a*.

A pair of shaft support members 25, 25 are fixed to the lower face of the support member 20, and a shaft 26 extends between the shaft support members 25 and 25. Further, a base end portion of a bending depression plate support 27 is rotatably connected to the shaft 26. Furthermore, the depression member support 27 is provided with a pair of fixing blocks 27*a* for detachably supporting base end portions of a bending depression plate (folding member) 28. Length of the gauge plate 24 is approximately the same as that of the bending depression plate 28 in Y direction. In FIG. 1, shown is a state where a pocket cloth P is mounted on the gauge plate 24, and the bending depression plate 28 is positioned over the gauge plate 24 for sandwiching the pocket cloth P and for downwardly bending the edge portion of the pocket cloth P. A plurality of the gauge plates 24 and the bending depression plate 28 having various sizes are prepared and are selectively connected to the gauge plate support member 23 and the depression member support 27, respectively in accordance with a size of the pocket cloth P.

An upper end portion of the depression member support 27 is connected to a tip end of a piston rod 30 of a pneumatic cylinder 29 fixedly mounted on the support member 20 for pivotally moving the depression member support 27, thereby pivotally moving the bending depression plate 28 in a vertical direction. The bending depression plate 28 has a free end fixedly provided with a folding plate 28*b* (see FIG. 2) for folding an outer edge portion of the pocket cloth P in perpendicular direction when the bending depression plate 28 is brought into pressure contact with the gauge plate 24 on which the pocket cloth P is placed.

A pair of generally L-shaped support blocks 31 are rotatably connected to both ends of the shaft 26. Further, a generally U-shaped folding segment support member 32 is placeable around the bending depression plate 28. The member 32 has a base portions detachably connected to the support blocks 31. On an upper face of the folding segment support member 32, five pneumatic cylinders 35 are provided at positions in confrontation with an outer contour of the bending depression plate 28. Each of the pneumatic cylinders 35 has a piston rod 34 (see FIG. 8(*a*)), whose tip end portion is attached with a folding segment 35. Each of the folding segments 35 has a L-shape cross section, and vertical position of the folding segment 35 is controllable relative to the pneumatic cylinder 33. On the other hand, a pair of pneumatic cylinders 36 are disposed at lateral sides of the support member 20. Each of the pneumatic cylinder 36 has a base end pivotally connected to the support plate 20 and has a piston rod 37 pivotally connected to an upper end portion of the support block 31. Incidentally, the above described pneumatic cylinders 21, 22, 29 and 36 constitute a drive means E for moving the gauge plate 24, the bending depression plate 28 and the folding segment support member 32 toward and away from the table 14.

Next, a label clamping mechanism G which is one of the essential arrangements of this invention will be described with reference to FIGS. 1 through 4. This label clamping mechanism G is adapted for producing a pocket portion PK to which a label L is stitched as shown in FIG. 3. The mechanism G is disposed at the upper external edge portion of the bending depression plate 28 as shown in FIG. 1. That is, the mechanism G has a support piece 40 threadingly fixed to the bending depression plate 28 by screws.

Figure 2:
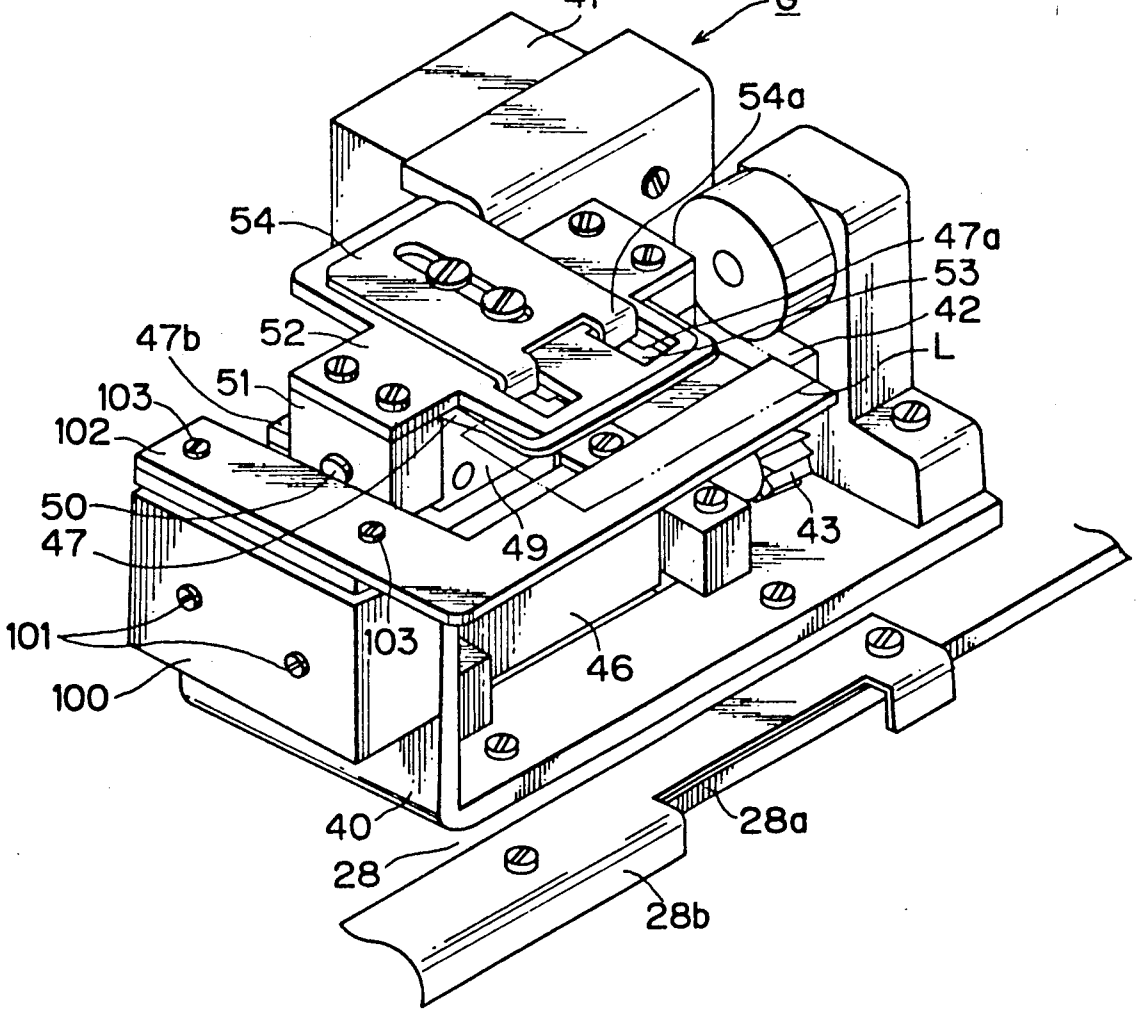
FIG. 2 is a perspective view showing the label clamping mechanism according to the embodiment.
Figure 3:
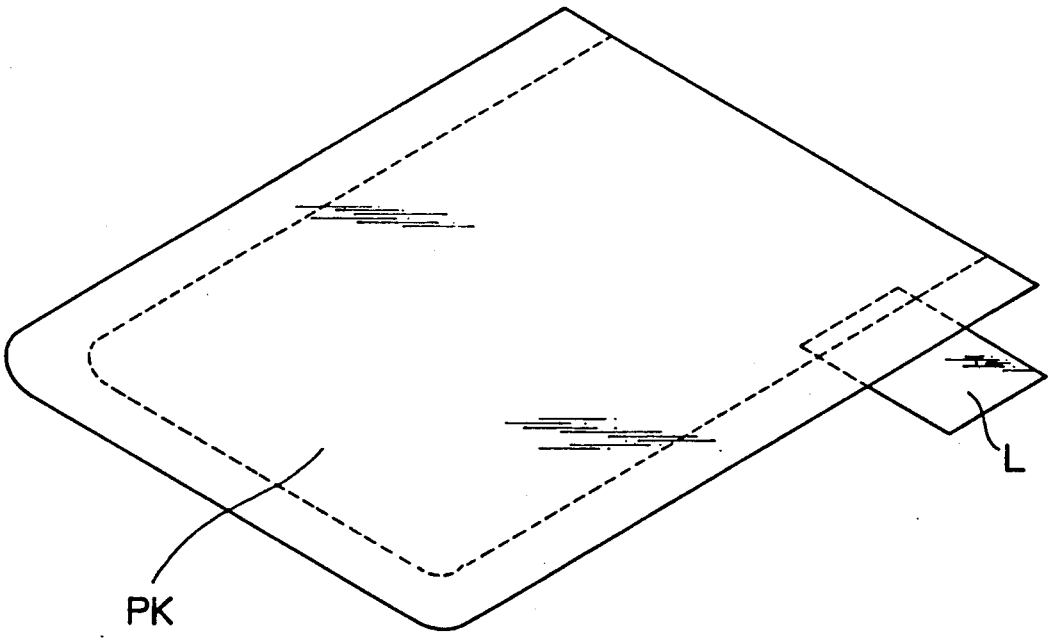
FIG. 3 is a perspective view for description of a label stitch position with respect to a pocket cloth.
Figure 4:
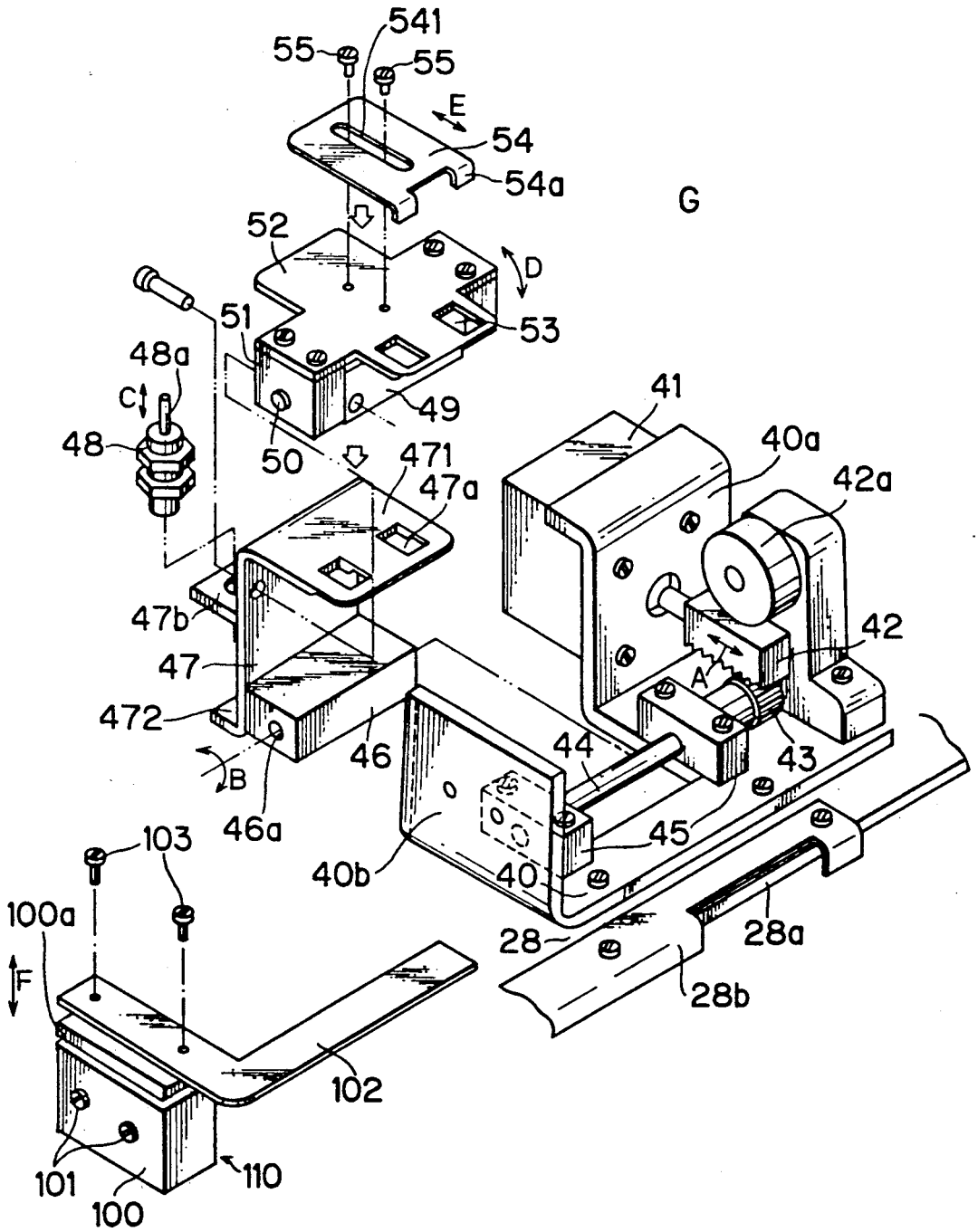
FIG. 4 is an exploded segmental view showing the label clamping mechanism according to the invention.

As shown in FIGS. 2 and 4, the end portion of the bending depression plate 28 is provided with the folding plate 28 in which a notched recess 28*a* is formed, and the label clamping mechanism G is disposed inside of the folding plate 28*b* relative to the external edge of the depression member 28. The support piece 40 has a first bent portion 40*a* extending in the vertical direction, to which a pneumatic cylinder 41 is fixed. The cylinder 41 has a piston rod to which a rack 42 is coupled. Further, on a bottom plate portion of the support piece 40, a first set of bushings 45 and 45 are mounted for rotatably supporting a first shaft 44. One end portion of the first shaft 44 extends through the one of the bushings 45, and a pinion 43 meshedly engageable with the rack 42 is fixedly mounted on the one end portion of the first shaft 44. Incidentally, a stop member 42*a* is rotatably provided for preventing the rack 42 from being displaced upwardly. Thus, in response to the actuation of the pneumatic cylinder 41, the rack 42 is moved frontwardly or rearwardly in a direction indicated by an arrow A, so that the pinion 43 and the first shaft 44 are rotated about a rotation axis.

The first shaft 44 has an intermediate portion between the first set of bushings 45 and 45. The intermediate portion is fixedly coupled to a shaft block 46. That is, the shaft block 45 is formed with a bore 46*a* to which the intermediate portion of the first shaft 44 is coupled. The shaft block 46 has a rear face fixed with a vertical section of a label stand 47. Thus, the shaft block 46 and the label stand 47 are pivotally movable about the axis of the first shaft 44 in response to the rotation thereof as shown by an arrow B. The label stand has an upper bent end portion 471 extending frontwardly and a lower bent end portion 472 extending rearwardly. The upper bent end portion 471 is formed with two openings 47*a*. Further, a rearwardly extending projection plate 47*b* extends from the vertical section of the label stand 47 for fixedly supporting a pneumatic cylinder 48 whose piston rod 48*a* is extendible and retractable in a vertical direction as shown by an arrow C.

At a front side of the vertical section of the label stand 47 and at position between the upper bend end portion 471 and the shaft block 46, another shaft block 49 is provided, and a second shaft 50 rotatably extends through the other shaft block 49. At both end portions of the second shaft 50, blocks 51 are fixed. Further, a cruciform shaped label presser 52 is mounted on the upper bend portion 471 for supporting the blocks 51. The label presser 52 is formed with openings 53 in alignment with the openings 47*a* of the label stand 47.

A label positioning piece 54 is mounted on the label presser 52. The label positioning piece 54 is formed with an elongated slot 541 through which screws 55 extend for fixing the positioning piece 54 to the label presser 52. The slot 541 extends in a frontward/rearward direction, so that the label positioning piece 54 is controlledly movable in this direction as shown by an arrow E. The positioning piece 54 has a front edge provided with two pawls 54*a*, 54*a* which extend into the openings 53,53 and 47*a*, 47*a*. The two pawls 54*a* extendible through the openings 53 and 47*a* are thrusted into the label L for fixedly securing the label L between the label stand 47 and the presser 52 (see also FIG. 6(*b*)). On the other hand, the piston rod 48*a* of the pneumatic cylinder 48 fixed to the label stand 47 is abuttable on a rear end portion of the label presser 52. A front end portion of the label presser 52 is normally contacted with the upper surface of the upper bent end portion 471 of the label stand 47 because of own weight of the presser 52. On the other hand, when, the label L is to be gripped, the label presser 52 is slightly angularly moved about an axis of the second shaft 50 in a direction indicated by an arrow D upon actuation of the pneumatic cylinder 48. This label stand 47, the label presser 52 and the pneumatic cylinder 48 constitute a label grip unit.

The support piece 40*a* also has a second bent section 40*b* extending in vertical direction to which a pneumatic cylinder 100 is fixed by screws 101, 101. A mount piece 100*a* is fixed to a piston rod of the pneumatic cylinder 100, and a L-shaped label guide 102 is fixed to the mount piece 100*a* by means of screws 103,103. Thus, the label guide 102 is movable in a direction indicated by an arrow F because of the actuation of the pneumatic cylinder 100. Relative position of the label guide 102 and the upper bent end portion 471 of the label stand 47 is shown in FIG. 6(*a*) as one example of the relative position. In this state, height of the label guide 102 from the bending depression plate 28 is approximately equal to height of the upper bent end portion 471 from the bending depression plate 28 and a small gap is provided between the label guide 102 and the upper bent end portion 471 in a horizontal direction, when the piston rod of the pneumatic cylinder 100 is retracted and when the piston rod of the pneumatic cylinder 41 is retracted for providing upstanding position of the label stand 47 capable of providing a setting state of the label L. The pneumatic cylinder 100, the mount piece 100*a* and the label guide 102 constitute in combination a label guide means 110. Incidentally, in FIGS. 5(*a*) and 5(*b*) foot switches S1 and S2 ares shown for selectively actuating and deenergizing the pneumatic cylinders.

Operation of the label clamping mechanism in the pocket setter according to the illustrated embodiment will next be described.

Figure 5A:
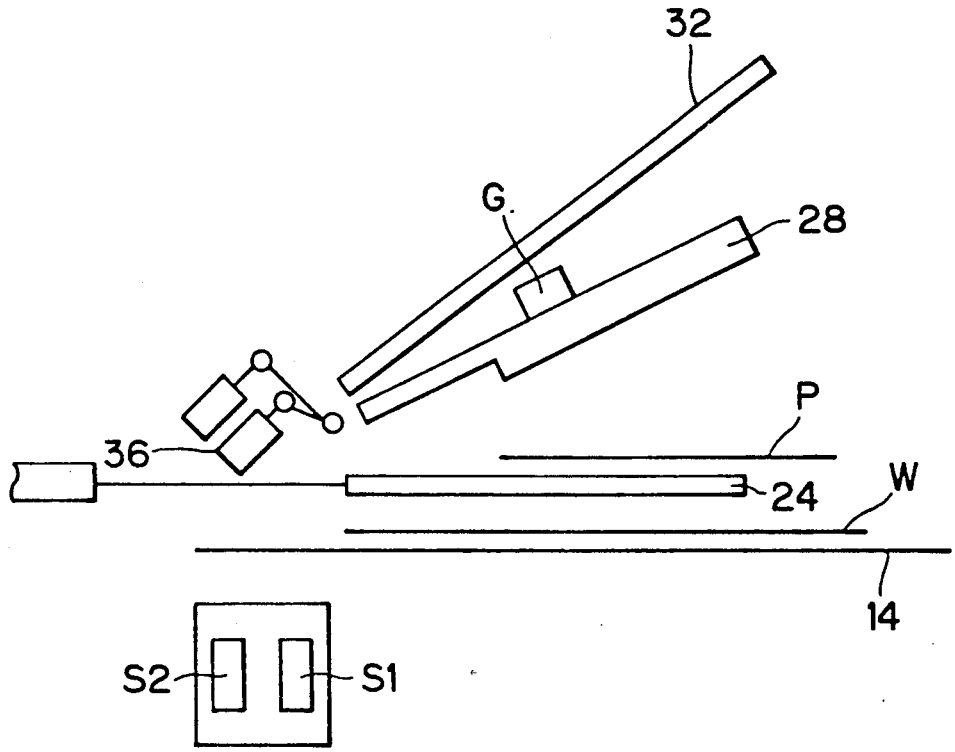
FIGS. 5(*a*) and 5(*b*) are schematic views for description of bending of an outer edge portion of a pocket cloth with the pocket setter of the embodiment.
Figure 5B:
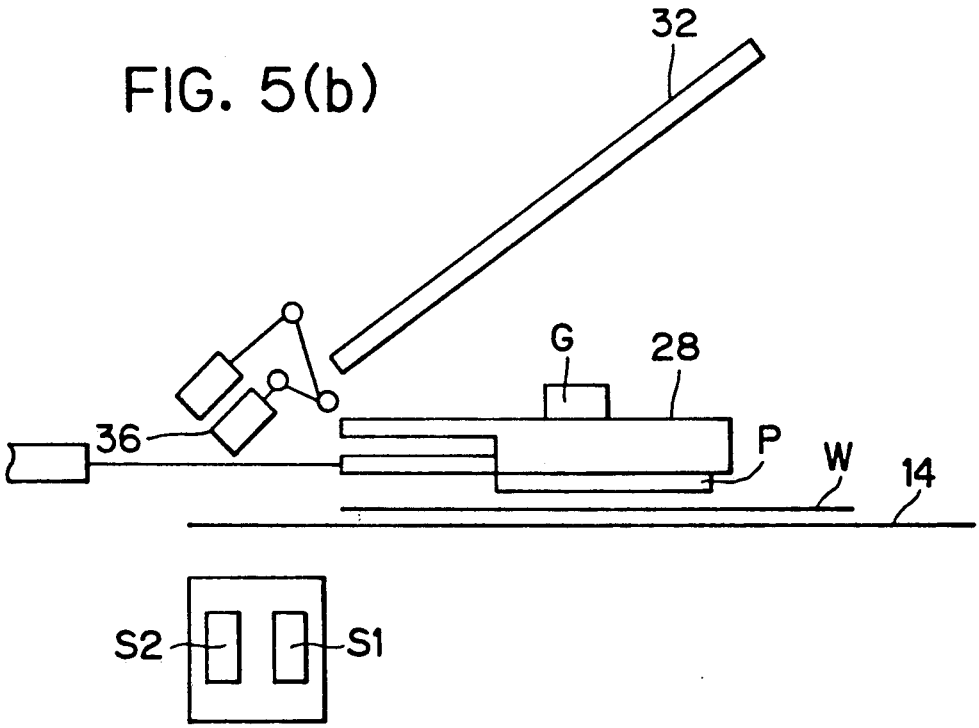
Figure 6A:
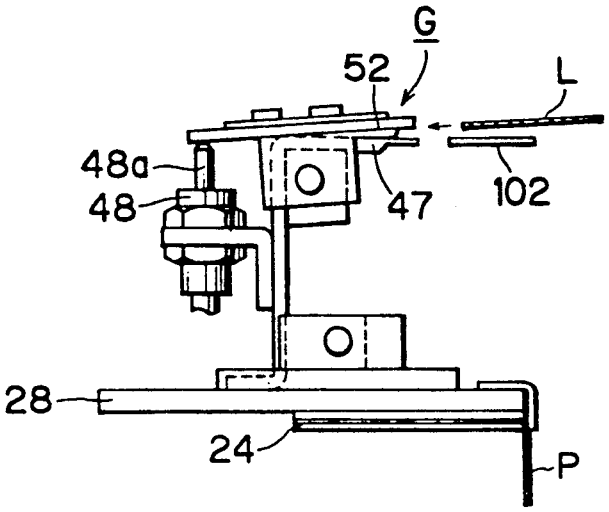
FIGS. 6(*a*) through 6(*c*) are schematic views for description of operational phases of the label clamping mechanism according to the embodiment.
Figure 6B:
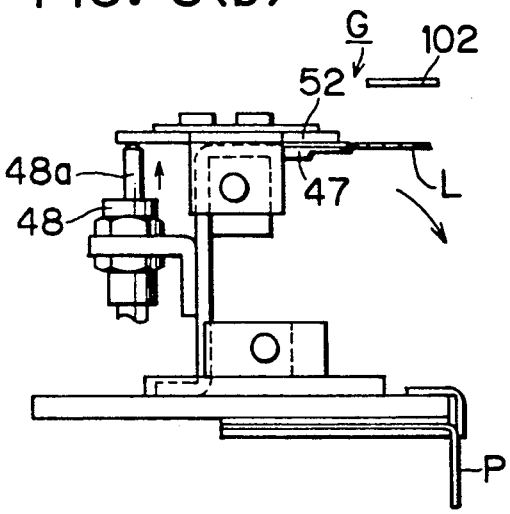
Figure 6C:
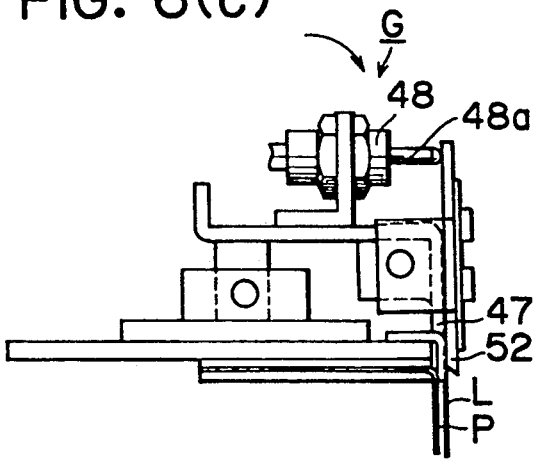

First, as shown in FIG. 5(*a*), the garment W is placed on the table 14, and at the same time, the gauge plate 24 is horizontally held above the garment W with a predetermined distance therefrom. Further, the pocket cloth P is mounted on the front upper end portion of the gauge plate 24, while the bending depression plate 28 has an upper pivot position for providing an open space between the pocket cloth P and the depression member 28.

Next, as shown in FIG. 5(*b*), the first foot switch S1 is rendered ON for downwardly pivoting the bending depression plate 28, so that the bending depression plate 28 is brought into pressure contact with the gauge plate 24. Therefore, an outer edge portion of the pocket cloth P is downwardly and perpendicularly folded on the gauge plate 24. (In FIG. 5(*b*), a lateral bent edge of the pocket cloth P is shown).

Maintaining this state, as shown in FIGS. 6(*a*) through 6(*c*), the label L is set on the label clamping mechanism G in the following manner. First, the label L is positioned on the label guide 102 and is interposed between the upper bent end portion 471 of the label stand 47 and the label presser 52, and then, the first foot switch S1 is rendered OFF. Therefore, the pneumatic cylinder 48 is actuated to extend the piston rod 48*a* for upwardly urging the rear end portion of the label presser 52. Consequently, the front portion of the label presser 52 is moved toward the label stand 47 about the axis of the second shaft 50, to thus firmly holding the label L between the presser 52 and the stand 47.

Figure 7:
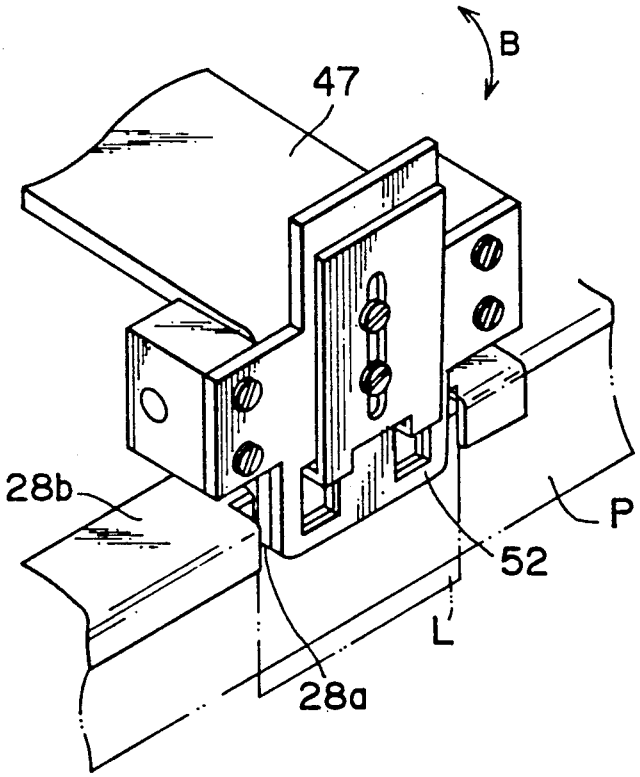
FIG. 7 is a perspective view for description of downwardly bending state of the label which is positioned in the vicinity of a downwardly bent portion of the outer edge portion of the pocket cloth.
Figure 8A:
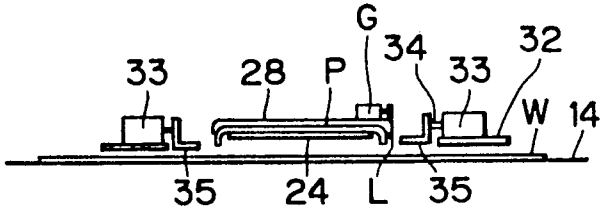
FIGS. 8(*a*) through 8(*f*) are schematic views showing label positioning sequence according to the one embodiment of this invention.
Figure 8B:
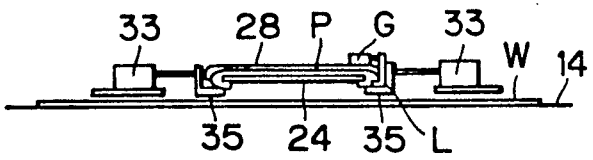
Figure 8C:
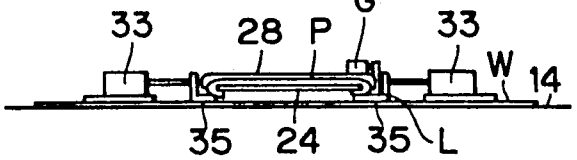
Figure 8D:
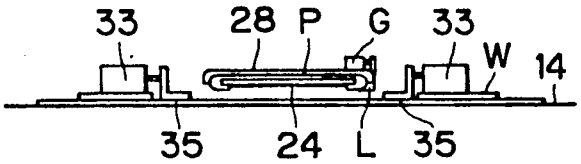
Figure 8E:
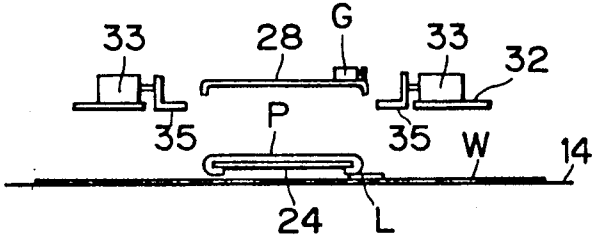
Figure 8F:
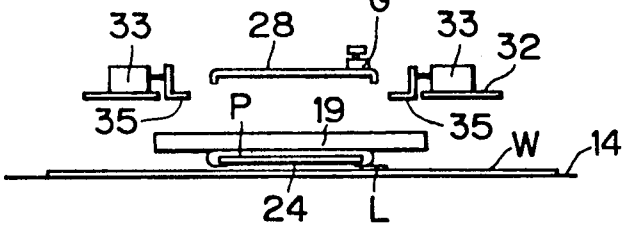

Then, the second foot switch S2 is rendered ON for actuating the pneumatic cylinder 100, so that the label guide 102 is moved to an upward retract position shown in FIG. 6(*b*) unobtrusive for a label setting operation (described later). After the actuation of the pneumatic cylinder 100, the cylinder 41 is actuated for angularly rotating the first shaft 44 about its axis through the pinion 43 and the rack 42. Thus, the label stand 47 and the label presser 52 are angularly and frontwardly moved by 90 degrees while interposing the label L between the upper bend end portion 471 and the presser 52 as shown in FIG. 6(*c*), so that the label L is brought to a given position. More specifically, as shown in FIG. 7, the upper bent end portion 471 of the label stand 47 is brought into engagement with the notched recess 28*a* of the folding plate 28*b*, so that the outer edge portion of the pocket cloth P is foldedly depressed in such a manner that the folded edge portion is directed in parallel with the remaining part of the label L.

The folding segment support member 32 is then pivotally moved by the actuation of the pneumatic cylinders 36, so that the member 32 is angularly moved from an upper rest position shown in FIG. 5(*a*) or 5(*b*) to a lower position shown in FIG. 8(*a*). Thus, the folding segment support member 32 is brought to a horizontal position where the folding segment support member 32 is facing with the bending depression plate 28.

Thereafter, as shown in FIG. 8(*b*), each of the pneumatic cylinders 33 is actuated for moving the associating folding segment 35 to a position beneath the gauge plate 24. Therefore, the outer edge portion of the pocket cloth P, which outer edge portion is defined by the abutment between the bending depression plate 28 and the gauge plate 24 as shown in FIG. 5(*b*), is further folded in such a manner that the outer edge portion is positioned in contact with a lower face of the gauge plate 24. In this case, a lower end portion of the label L is also folded back toward the lower face of the gauge plate 24 together with the folding of the outer edge portion of the pocket cloth P.

Next, as shown in FIG. 8(*c*), the support member 20, the gauge plate 24 and the folding segment support member 32 are downwardly moved onto the table 14 by the actuation of the driving means E. That is, as shown in FIG. 8(*c*), the lower surface of the folding segment support member 32 and the folding segments 35 are seated onto the table 14.

Then, as shown in FIG. 8(*d*), the folding segments 35 are moved away from the end of the gauge plate 24 by the actuation of the pneumatic cylinders 33, so that the folding segment 35 is disengageable from the edge portion of the pocket cloth P. Simultaneously, label clamping mechanism G releases the label L. Accordingly, the label L is linearly oriented while one end portion of the label L is positioned below the folded edge portion of the pocket cloth P.

Then, as shown in FIG. 8(*e*), the driving means E is again actuated for lifting the folding segment support member 32 and the bending depression plate 28, so that these are moved away from the pocket cloth P. In this case, the pneumatic cylinder 100 is operated to restore the original position.

Thereafter, as shown in FIG. 8(*f*), the feed plate 19 is moved to a position above the pocket cloth P on the gauge plate 24 and is downwardly moved. Thus, the pocket cloth P, the gauge plate 24 and the label L are urged to be pressed onto the garment W. Next, by actuating the pneumatic cylinder 22 (FIG. 1), the gauge plate 24 is rearwardly moved to be separated from the pocket cloth P, and thereafter, the feed plate 19 is moved to the needle location together with the movement of the garment W on which the pocket cloth P and the label L are placed. Then, the sewing machine 11 is operated and the feed plate 11 is moved in X and Y-directions for stitching the pocket cloth P and the label L to the garment W, to thereby provide the pocket PK stitched with the label L as shown in FIG. 3.

Figure 9:
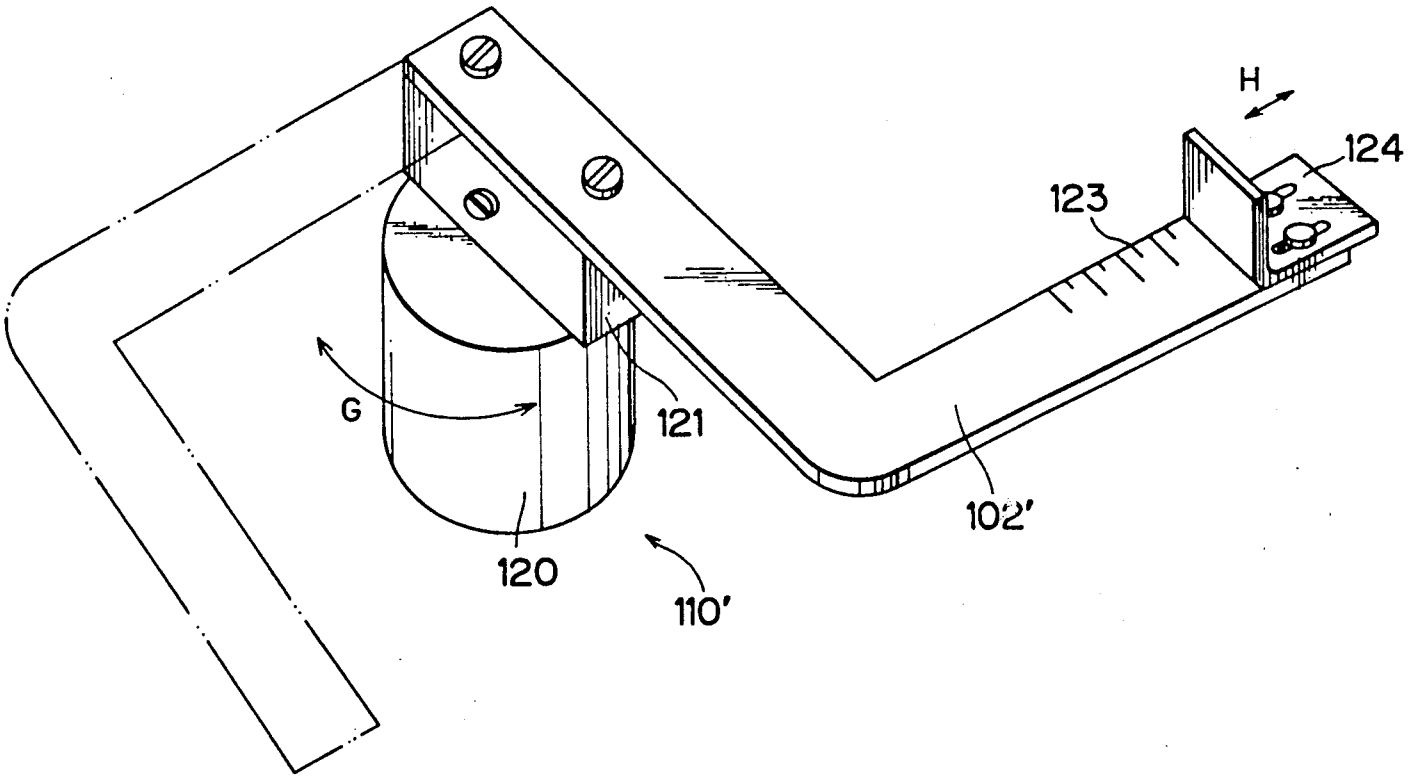
FIG. 9 is a perspective view showing a label guide portion according to a second embodiment of this invention.

A modification of a label guide is shown in FIG. 9. According to the modification, a label guide 102' is fixed to a label guide attaching member 121, which is fixed to a plunger of a rotary cylinder 120. Thus, the label guide 102' is rotatable in a horizontal plane as indicated by an arrow G. The rotary cylinder 120 is fixed to the bending depression plate 28. A scale 123 is engraved on a surface of the label guide 102 for facilitating positioning of the label L thereon. Further, a label positioning piece 124 is provided which is movable in a lengthwise direction of the label L as indicated by an arrow H.

With this arrangement, the label guide 102' is initially positioned adjacent the label stand 47 in a manner similar to the embodiment shown in FIG. 6(*a*). After the clamp of the label L by mounting the label onto the label guide 102' and by clamping the label L between the upper bend end portion 471 of the label stand 47 and the label presser 52, the label guide 102' is rotated in a horizontal plane to its retracted position in the direction G by the actuation of the rotary cylinder 120. Thus, subsequent operation can be achieved without any interference from the label guide 102'. Thus, in the modified embodiment, the positioning of the label L in its widthwise direction can be promptly achieved.

In the embodiment shown in FIG. 6(*b*), the label guide 102 has the upper offsetting rest position. On the other hand, in the modified embodiment, the label guide 102' has a rest position as indicated by two dotted chain line in FIG. 9. However, the rest position of the label guide 102 or 102' is not limited to the illustrated embodiments, but other rest positions may be conceivable so far as the label guide does not affect the subsequent pocket cloth folding operation. Incidentally, the clamping depth of the label L is determined by the engagement of the pawls 54a with the label L.

As described above, according to the present invention, the label stand 47 of the label clamping mechanism G is angularly rotatable by frontward 90 degrees so as to position the label L clamped by the label stand 47 and the label presser 52 at the folded position of the outer edge portion of the pocket cloth P. Accordingly, the label L can be easily attached to the pocket PK. Further, when the label clamping mechanism G clamps the label L, the label stand 47 and the label presser 52 are both oriented in the horizontal direction at a position above the bending depression plate 28. Accordingly, the label clamping portion can be easily observed for facilitating the label clamping work. Furthermore, after the label L is clamped between the label stand 47 and the tip end portion of the label presser 52, these are pivotally rotated by 90 degrees for positioning the label at the position of the folded portion of the pocket cloth P. Accordingly, the label clamping area or length can be reduced.

Moreover, according to the depicted embodiment, the label clamping mechanism is positioned in a vicinity of the bent portion of the outer edge portion of the pocket cloth P which has been downwardly bent by the bending depression plate. Further, the label clamping mechanism is provided with the label guide 102 or 102' for horizontally guiding the label L for facilitating label insertion into the label clamping section. Consequently, the label clamping work can be smoothly carried out.

While the invention has been described in detail and with reference to specific embodiment thereof, it would be apparent to those skilled in the art that various changes and modifications may be made therein without departing from the spirit and scope of the invention. For example, in the illustrated embodiment, the label clamping mechanism G is mounted on the bending depression plate 28. However, the clamping mechanism G can be mounted on the folding segment support member 32.

What is claimed is:

1. A workpiece fabric folding device for use in a sewing machine for folding an outer edge portion of a first workpiece fabric, the sewing machine having a sewing table on which a second workpiece fabric is mounted, the folded outer edge portion being stitched to the second workpiece fabric, the device comprising:

a gauge plate positioned above the sewing table for mounting thereon the first workpiece fabric, the gauge plate having an outer edge;

a bending depression member movably positioned above the gauge plate for downwardly bending the outer edge portion of the first workpiece fabric along a contour of the outer edge of the gauge plate;

a plurality of folding segments movable to a position below the gauge plate for defining a folded-back position of the outer edge of the first workpiece fabric so as to position the downwardly bent portion of the first workpiece fabric at a position immediately below the gauge plate; and a label clamping mechanism positioned adjacent the folded-back position of the outer edge portion of the first workpiece fabric and comprising a label clamping means for clamping a part of a label, and moving means for moving the clamping means between a label receiving and clamping position and a label foldable position where the label is oriented in a direction parallel with the downwardly bent outer edge portion of the first workpiece fabric.

2. The workpiece fabric folding device as claimed in claim 1, wherein the label clamping mechanism is disposed on the bending depression member.

3. The workpiece fabric folding device as claimed in claim 2, wherein the label clamping mechanism further comprises a support means fixed to the bending depression member for supporting the label clamping means and the moving means.

4. The workpiece fabric folding device as claimed in claim 3, wherein the label clamping means comprises:

a label stand for mounting thereon a part of the label, the label stand being angularly movable; and a presser means movably supported to the label stand, the presser means having a first position for clamping the part of the label between the label stand and the presser means and having a second position for unclamping the part of the label.

5. The workpiece fabric folding device as claimed in claim 4, wherein the label clamping means further comprises presser drive means connected between the label stand and the presser means for moving the presser means between the first and the second positions.

6. The workpiece fabric folding device as claimed in claim 4, wherein the presser means is pivotally supported to the label stand.

7. The workpiece fabric folding device as claimed in claim 5, wherein the label stand comprises:

a vertical section having an upper end portion and a lower portion, an upper bent end portion extending from the upper end portion of the vertical section in a direction perpendicular thereto for mounting the part of the label on the upper bent end portion, the upper bent end portion being formed with at least one opening; and a rearwardly extending plate extending rearwardly from the vertical section for mounting thereon the presser driving means.

8. The workpiece fabric folding device as claimed in claim 7, wherein the presser means comprises;

a shaft block fixedly secured to the vertical section of the label stand;

a shaft rotatably extending through the shaft block, the shaft having end portion;

at least one block fixed to the end portion of the shaft; and a label presser positioned above the upper bent end portion of the label stand and supporting the at least one block, the label presser being connected to the presser drive means and pivotable about an axis of the shaft, the label presser being formed with at least one opening in alignment with the opening of the upper bent end portion, wherein the label presser is moved by the presser drive means between the first and second positions.

9. The workpiece fabric folding device as claimed in claim 8, wherein the presser means further comprises a label positioning piece positioned above the label presser and having at least one pawl passable through the openings when the label presser is in the first position.

10. The workpiece fabric folding device as claimed in claim 3, wherein the moving means comprises:

a drive means supported on the support means;

a rotation shaft rotatably supported by the support means and angularly rotatable about its axis by the drive means; and a shaft block integrally coupled to the rotation shaft and fixedly connected to the label clamping means, the drive means providing a first angular position of the label clamping means where the label clamped by the clamping means is horizontally oriented at the label receiving and clamping position and a second angular position of the label clamping means where the label is vertically oriented at a position adjacent the downwardly bent outer edge portion of the first workpiece fabric in parallel therewith.

11. The workpiece fabric folding device as claimed in claim 9, wherein the moving means comprises:

a drive means supported on the support means;

a rotation shaft rotatably supported by the support means and angularly rotatable about its axis by the drive means; and a shaft block integrally coupled to the rotation shaft and fixedly connected to the lower portion of the label stand for pivotally moving the label stand about an axis of the rotation shaft, the drive means providing a first angular position of the label stand where the upper bent end portion is horizontally oriented and a second angular position where the upper bent end portion is vertically oriented.

12. The workpiece fabric folding device as claimed in claim 11, wherein the bending depression member is formed with a notched recess at a side portion thereof, the label presser and the upper bent end portion of the label stand being positioned within the notched recess when the label stand has the second angular position for positioning the label in confronting relation to the downwardly bent portion of the first workpiece fabric at the label foldable position.

13. The workpiece fabric folding device as claimed in claim 2, further comprising a guide means mounted on the bending depression member, the guide means having a label guiding position at a position adjacent the label stand when the label stand has the first angular position and having a retracted position remote from a pivotal moving locus of the label stand moving toward the second angular position.

14. The workpiece fabric folding device as claimed in claim 12, further comprising a guide means mounted on the bending depression member, the guide means having a label guiding position at a position adjacent the label stand when the label stand has the first angular position and having a retracted position remote from a pivotal moving locus of the label stand moving toward the second angular position.

15. The workpiece fabric folding device as claimed in claim 14, wherein the guide means comprises;

a label guide plate on which a remaining part of the label is to be mounted for facilitating horizontal insertion of the label into a position between the upper bent end portion and the label presser; and a moving means mounted on the support means and connected to the label guide plate for moving the label guide plate between a first vertical position where the label guide plate is positioned adjacent the upper bent end portion and a second vertical position where the label guide plate is positioned remote from the pivotal moving locus of the upper bent end portion and the label presser.

16. The workpiece fabric folding device as claimed in claim 14, wherein the guide means comprises:

a label guide plate on which a remaining part of the label is to be mounted for facilitating horizontal insertion of the label into a position between the upper bent end portion and the label presser; and moving means mounted on the bending depression member and connected to the label guide plate for angularly moving the label guide plate in a horizontal plane between a first horizontally angular position where the label guide plate is positioned adjacent the upper bent end portion and a second horizontally angular position where the label guide plate is positioned remote from the pivotal moving locus of the upper bent end portion and the label presser.

* * * * *